US005642635A

United States Patent [19]

Wen-Chyun

[11] Patent Number: 5,642,635

[45] Date of Patent: Jul. 1, 1997

[54] LOCK FOR A VEHICLE WHEEL

[76] Inventor: Su Wen-Chyun, No. 5, Alley 3, Lane 88, Wu-Chyuan Rd., Shen-Kang Hsiang, Taichung Hsien, Taiwan

[21] Appl. No.: 545,500

[22] Filed: Oct. 19, 1995

[51] Int. Cl.[6] ..... E05B 67/10

[52] U.S. Cl. ..... 70/46; 70/58; 70/227; 70/233

[58] Field of Search ..... 70/46, 18, 58, 70/227, 233

[56] References Cited

U.S. PATENT DOCUMENTS

| | | | |
|---|---|---|---|
| 177,814 | 5/1876 | Delkescamp | 70/18 |
| 226,069 | 3/1880 | Hathaway | 70/18 |
| 647,408 | 4/1900 | Houts | 70/18 |
| 683,286 | 9/1901 | Houser | 70/18 |
| 1,343,709 | 6/1920 | Chapman | 70/18 |
| 1,347,467 | 7/1920 | Scott et al. | 70/18 |
| 3,747,376 | 7/1973 | White, Jr. | 70/18 |
| 4,986,095 | 1/1991 | Chou et al. | 70/18 |
| 4,987,753 | 1/1991 | Kuo | 70/39 |
| 5,253,496 | 10/1993 | Wang | 70/38 R |
| 5,433,092 | 7/1995 | Kuo | 70/18 |
| 5,475,993 | 12/1995 | Kuo | 70/18 |
| 5,488,844 | 2/1996 | Winner | 70/18 |
| 5,568,740 | 10/1996 | Lin | 70/49 |

*Primary Examiner*—Steven N. Meyers
*Assistant Examiner*—Donald J. Lecher
*Attorney, Agent, or Firm*—Morton J. Rosenberg; David I. Klein

[57] ABSTRACT

There is provided a lock for securing a vehicle or a component thereof which comprises two half-collars and a locking mechanism for locking the engagement of those two half-collars. Each of the two half-collars includes a first end and a second end, the first ends of the two half-collars being pivotally coupled. The two second ends of the half-collars are lockingly engaged by use of a plug-socket locking mechanism which enables convenient locking and unlocking in a portable, space-efficient assembly.

4 Claims, 13 Drawing Sheets

LOCK FOR A VEHICLE WHEEL

BACKGROUND OF THE INVENTION

1. Field of the Invention

The present invention relates to a lock for a vehicle wheel, and more particularly, to a lock comprising a pair of half-collar locking units.

2. Description of the Prior Art

Along with the growth in popularity of vehicles such as motorcycles has grown the need to prevent their theft. Key-operated engine ignitions offer an owner some measure of protection from theft, but additional protective measures are typically necessary for reasonably effective theft prevention.

A lock assembly commonly used for immobilizing a wheel of a motorcycle during those periods when it is unattended is a U-shaped assembly attached to the front wheel, as shown in FIG. 20 and FIG. 21. Such an assembly comprises a lock A and a U-shaped locking bar B which locks therein to form an enclosed collar. The assembly may be placed into service by inserting the appropriate key in the lock A; holding with one hand the lock A and with the other hand the U-shaped locking bar B; bringing the two parts together from opposing sides of the wheel C; and, manipulating the terminal ends of the U-shaped locking bar B through intervals between the spokes of wheel C to then engage lock A. The assembly is removed by inserting and turning the key in the lock A and drawing apart lock A and U-shaped locking bar B from the opposing sides of the wheel C.

Use of the prior art lock assembly, as evident from the description above, is quite cumbersome due, in part, to the following:

1. Because the lock A and locking bar B are completely separable parts, cooperative use of both the user's hands is necessary for their manipulation, and sufficient working space is required on both sides of the wheel such that adequate clearance is available for this manipulation.

2. The lock A and the locking bar B are dimensionally quite substantial and are, therefore, rather bulky and cumbersome to operate.

SUMMARY OF THE INVENTION

In view of the above-mentioned shortcomings in the prior art, the present invention provides a lock for a vehicle wheel which comprises two half-collars and a lock assembly. A first end of one half-collar is pivotally coupled to a first end of the other half-collar. A lock assembly is formed at a second end of one half-collar to lockingly receive therein a second end of the other half-collar. The lock of the present invention may be manipulated even in tight spatial confines, given that it is a unitary assembly which does not require two-handed manipulation. The lock is also less bulkier and, thus, less cumbersome to operate than prior art lock assemblies.

DESCRIPTION OF THE PREFERRED EMBODIMENT

Figure 1:
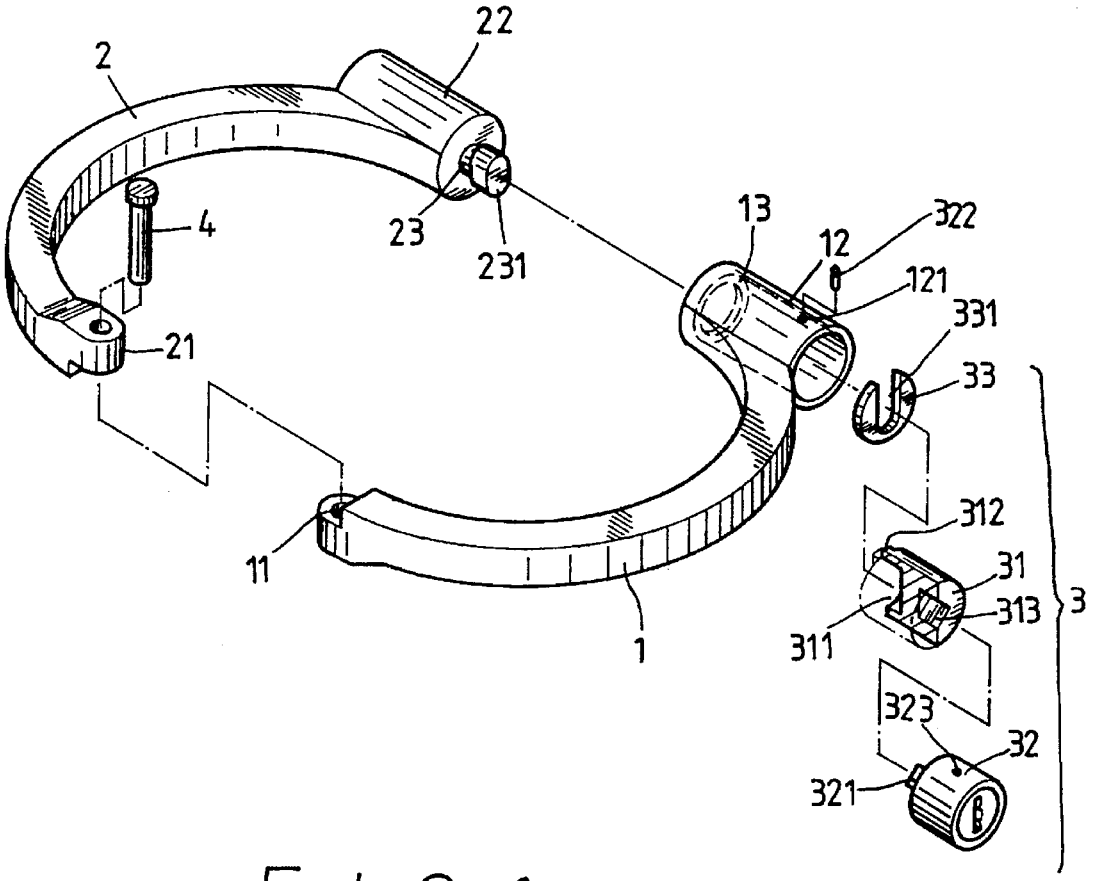
FIG. 1 is an exploded perspective view showing a preferred embodiment of the present invention.
Figure 2:
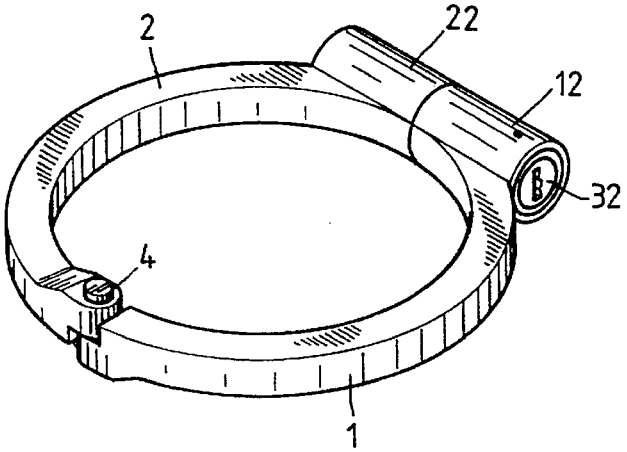
FIG. 2 is a perspective view showing the preferred embodiment of the present invention in its locked state.
Figure 3:
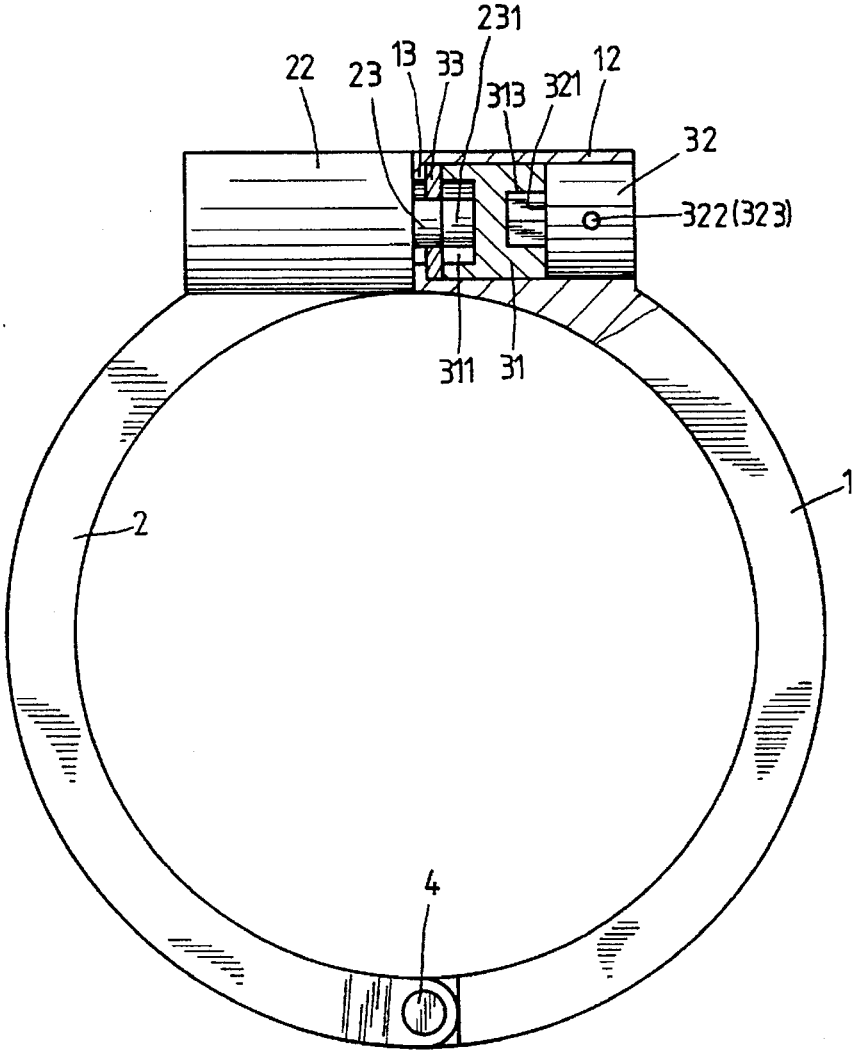
FIG. 3 is a plan view, partially cut-away, showing the preferred embodiment of the present invention in its locked state.

Referring to FIG. 1 to FIG. 3, the present invention comprises a primary half-collar 1, a secondary half-collar 2, and a lock assembly 3. One of the ends of the two half-collars are pivotally coupled. The other respective ends form the plug-socket locking mechanism which employs lock assembly 3.

Primary half-collar 1 includes a first end through which an opening 11 is formed. Similarly, secondary half-collar 2 includes a first end through which an opening 21 is formed. The openings 11, 21 receive therethrough a pin 4 to form a hinged joint. Each of the primary and secondary half-collars 1, 2 also includes a second end. The second end of primary half-collar 1 is formed with a cylindrical locking bed 12 having a cylindrical inner chamber defined coaxially therethrough. The second end of secondary half-collar 2 is formed with a cylindrical lock block 22. An annular leading edge 13 having an inner diameter less than the diameter of this inner chamber is formed on the locking bed 12. A plug member 23 having a neck portion and an oval-shaped lobe portion 231 is formed on the lock block 22. Lock block 22 is thus formed to be axially inserted into locking bed 12 through the opening defined by leading edge 13.

Lock assembly 3 is coaxially disposed within the inner chamber of locking bed 12. Lock assembly 3 includes a follower 31, a lock cylinder 32, and a clip 33. Follower 31 is fitted within the inner chamber of locking bed 12 to be axially rotatable therein. At one end of follower 31, there is a cylindrical counterbore 311 having a diameter slightly greater than the diameter of the oval lobe portion 231 of lock block 22. An axially protruding lobe 312 is formed at the periphery of counterbore 311 for engagement with a U-shaped opening 331 formed radially through clip 33. At the other axial end of follower 31 is formed a polygonal counterbore 313. Cylinder 32 is formed with a lug 321 protruding axially therefrom for engaging insert into polygonal counterbore 313.

Clip 33, follower 31, and cylinder 32 are coaxially assembled within the inner chamber of locking bed 12, being captured therein against leading edge 13 by the radial insert of a pin 322 through a securement opening 121 formed through locking bed 12 into engagement with a securement bore 323 formed in cylinder 32. When a matched key (not shown) is inserted and turned within cylinder 32, lug 321 causes follower 31 to turn accordingly. This, in turn, causes lobe 312 to turn clip 33 accordingly.

Figure 4:
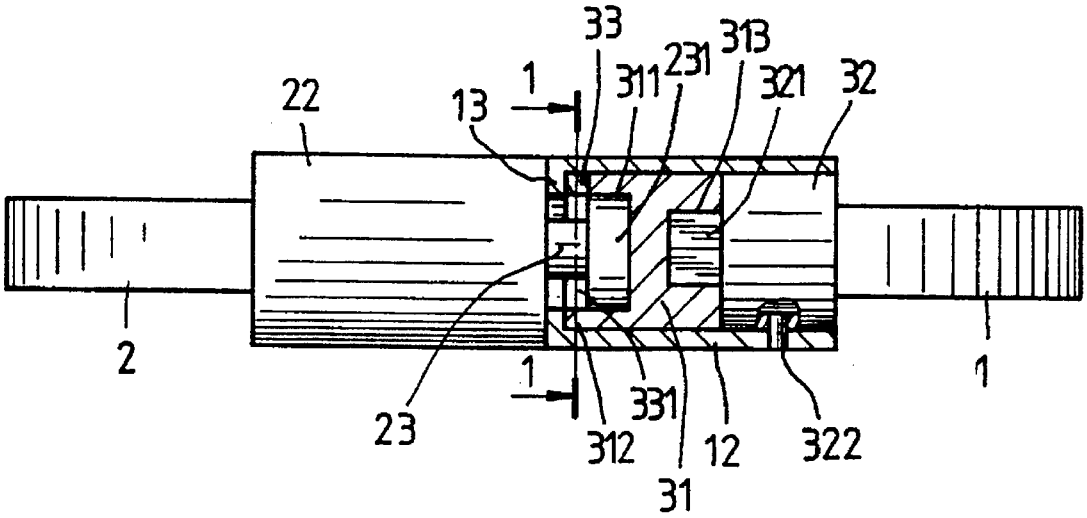
FIG. 4 is an elevational view, partially cut-away, of the preferred embodiment of the present invention shown in its unlocked state.
Figure 5:
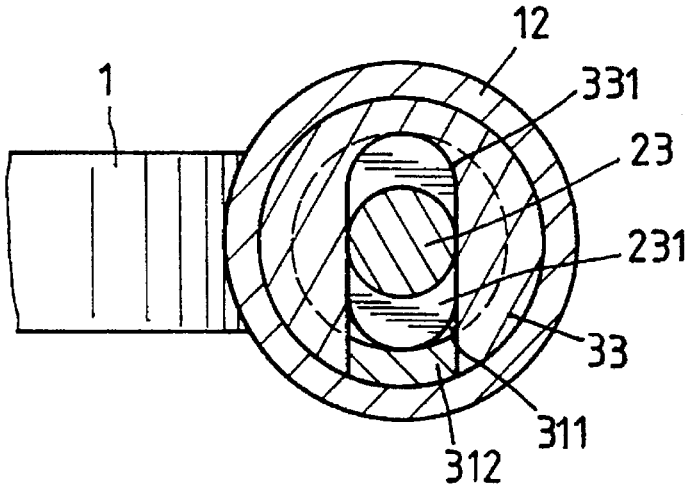
FIG. 5 is a cross-sectional view taken along arrows 1—1 of FIG. 4.
Figure 6:
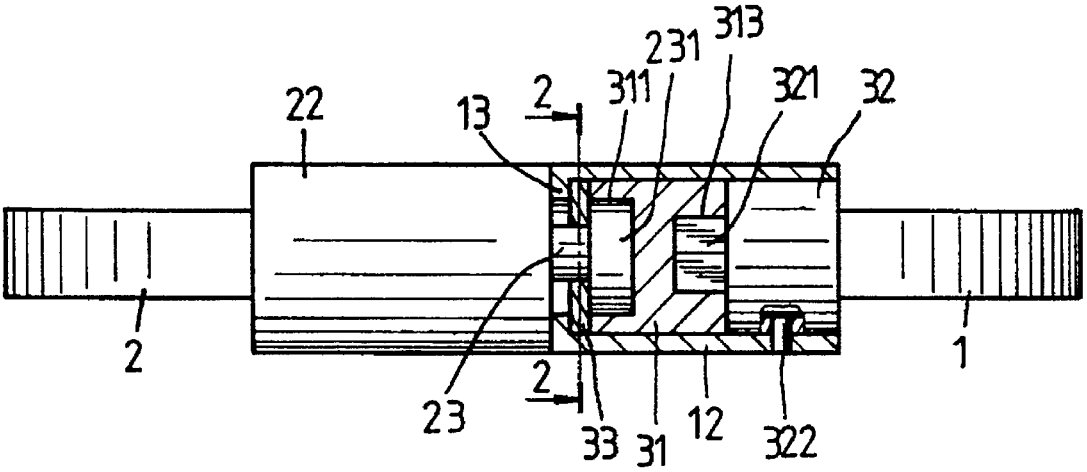
FIG. 6 is an elevational view, partially cut-away, of the preferred embodiment of the present invention shown in its locked state.
Figure 7:
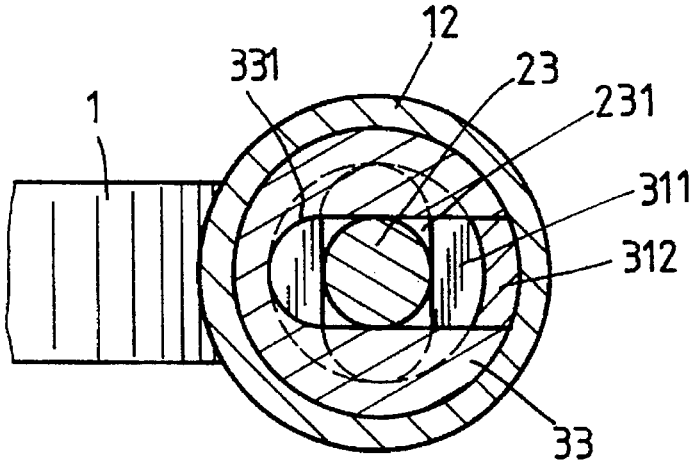
FIG. 7 is a cross-sectional view taken along arrows 2—2 of FIG. 6.

Referring now to FIGS. 4 and 5, when the lock described above is in its locked configuration, the primary and secondary half-collars are joined at both ends to form a locking collar. The neck portion of the plug member 23 formed on lock block 22 extends axially through the central opening of the leading edge 13 and into opening 331 of clip 33, the lobe portion 231 extending into counterbore 311 of follower 31 in locking bed 12. To lock this engagement, a matched key (not shown) may be inserted into cylinder 32 and turned by a sufficient angle, as shown in FIGS. 6 and 7, to cause follower 31, as it is rotated by lug 321, to bring the elongate opening 331 of clip 33 into transverse orientation relative to oval lobe block 231 of plug member 23. This causes the oval lobe block 231, which passed freely through the opening 331 of clip 33 when it was in substantially parallel alignment with that opening 331, to now be blocked from passage therethrough. It is thereby lockingly coupled to lock assembly 3.

Figure 8:
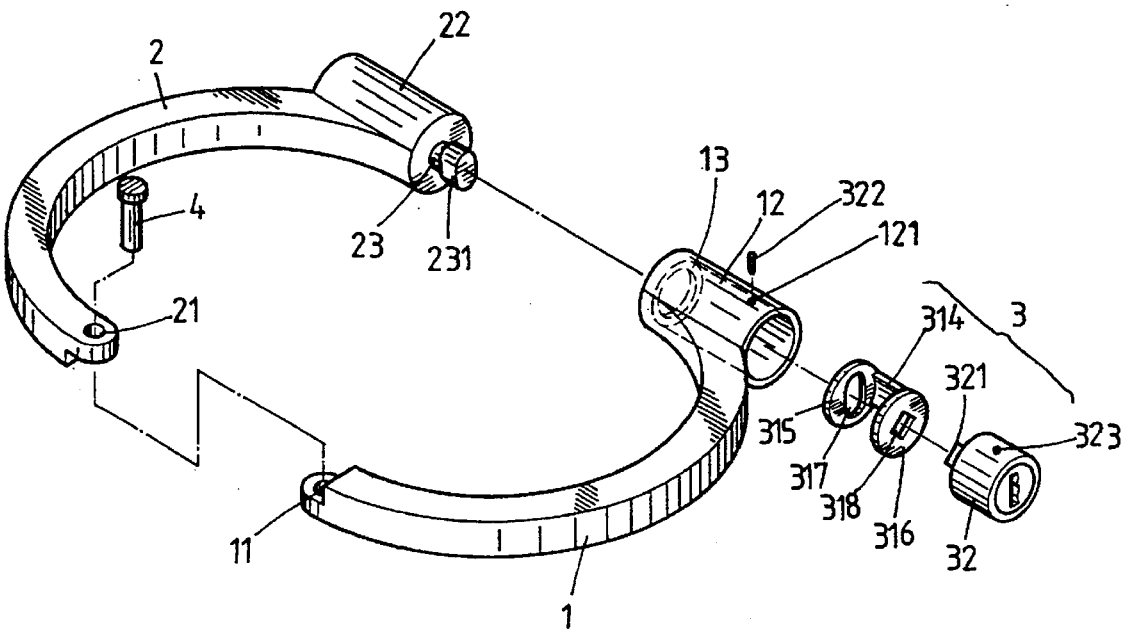
FIG. 8 is an exploded perspective view showing a second embodiment of the present invention.

Referring now to FIG. 8, there is shown an alternate embodiment of the present invention. In this embodiment, follower 31 is formed with a camber surface connecting strip 314 instead of the original cylindrical body extending between two end surfaces. A disk 315 having an elongate opening 317 forms one end surface and serves the function served by clip 33 in the preferred embodiment of FIGS. 1–7. Another disk 316 having a polygonal or non-circular opening 318 is formed as the other surface to receive lug 321 of cylinder 32 therethrough.

Figure 9:
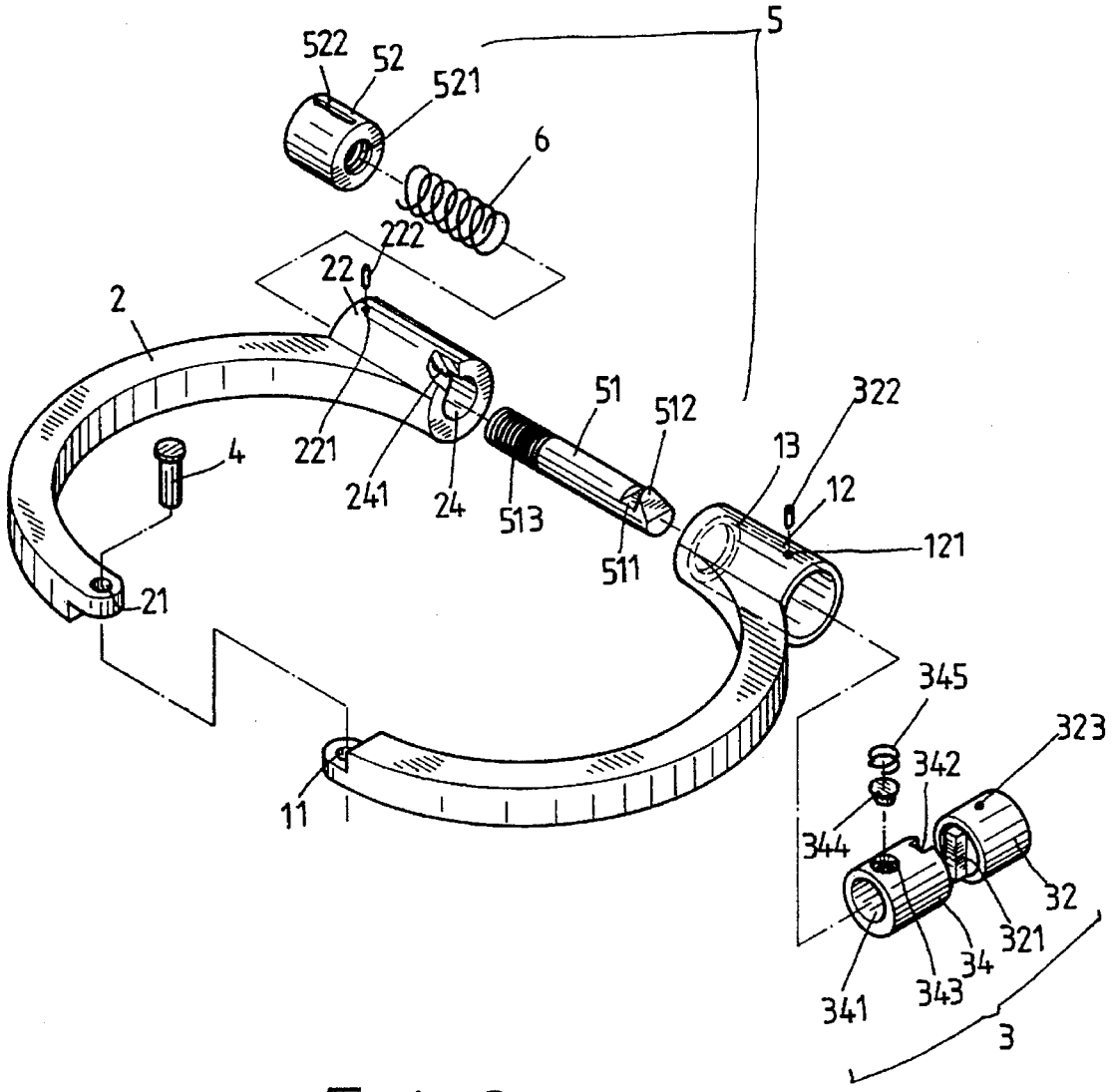
FIG. 9 is an exploded perspective view showing a third embodiment of the present invention.
Figure 10:
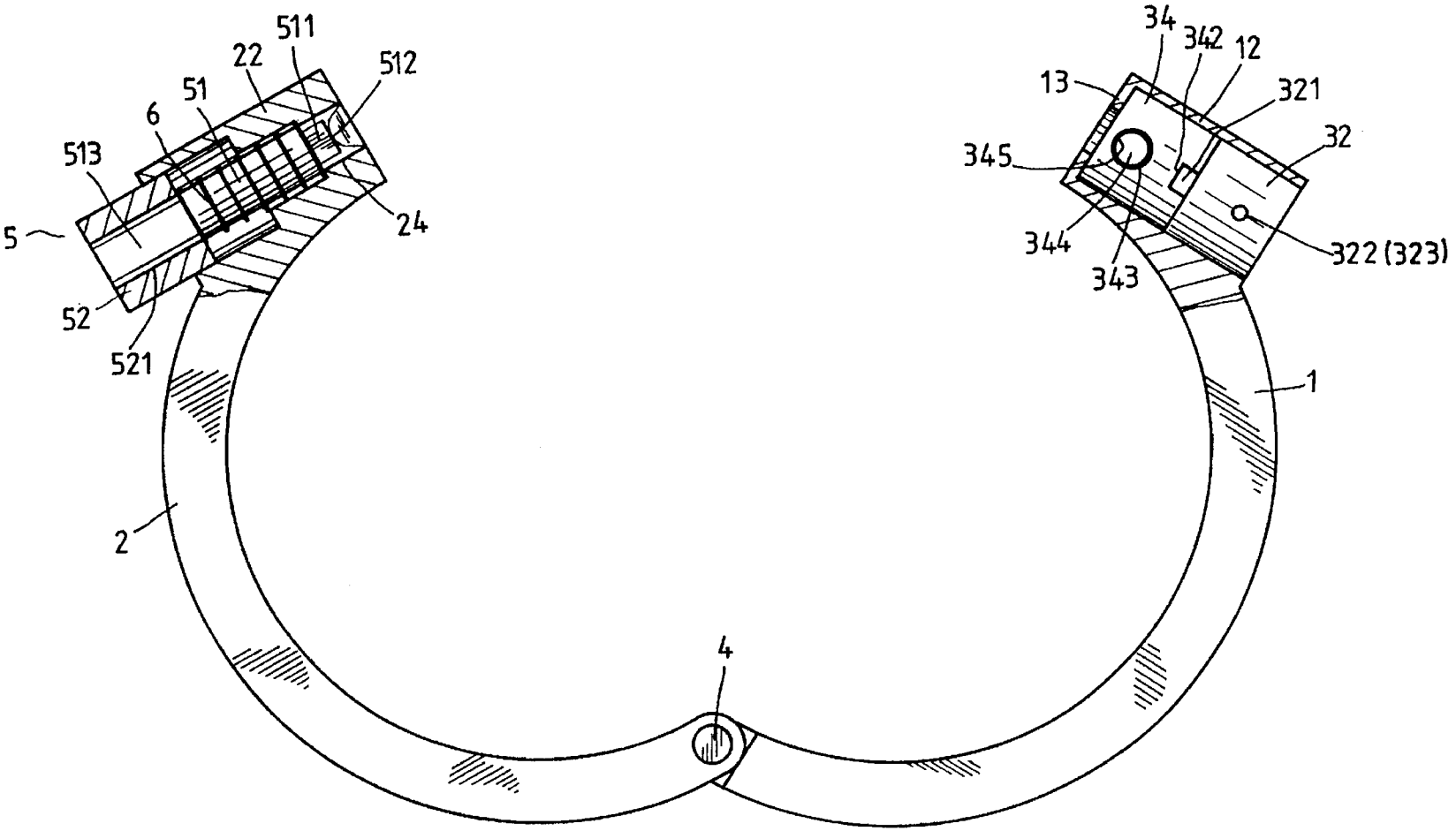
FIG. 10 is a plan view, partially cut-away, showing the third embodiment of the present invention in its unlocked, open state.

Referring now to FIGS. 9 and 10, there is shown another alternate embodiment of the present invention. In this embodiment, locking bed 12 houses a lock assembly 3 which includes a follower 34 and a cylinder 32. Follower 34 is formed having a tubular contour, the end opposing leading edge 13 having a counterbore 341 formed therein. An opening 343 is formed adjacent this end for passage therethrough of a step latch 344 and a spring 345. The other end of follower 34 is formed with a camming slot 342 for receiving a camming block 321 formed onto one end of cylinder 32.

Follower 34, latch 344, spring 345, and cylinder 32 are installed within locking bed 12 and captured therein by the insertion of pin 322 through and into securement openings 121 and 323. On the other side of the lock, lock block 22 is formed with a generally tubular configuration. One end of lock block 22 has formed therein a counterbore 24 with a flange 241 such that lock block 22 may receive a latch assembly 5 and a spring 6.

Latch assembly 5 includes a step latch 51, about which spring 6 is coaxially received. One end 513 of step latch 51 has formed thereon a plurality of threads for engaging a circular nut 52. Circular nut 52 has an internally threaded opening 521 and has an outside wall having a slide slot 522 formed therethrough to receive a pin 222 which prevents undesirable radial displacement of circular nut 52. The other end of step latch 51 is formed as a latch hook defined by a locking slot 511 and a slanted surface snap head 512. Latch 5 is assembled by passing step latch 51 axially through counterbore 24, such that spring 6 which is coaxially received on latch 51 is captured and compressed between flange 241 and the latch hook; and, the threaded end 513 extends through the other axial side of flange 241. Circular nut 52 is then matingly coupled to the threaded end 513, and pin 222 is passed through a securement opening 221 in block 22 and into slide slot 522. The latch hook is thus biased to extend axially outward from counterbore 24 by the force of spring 6.

Figure 11:
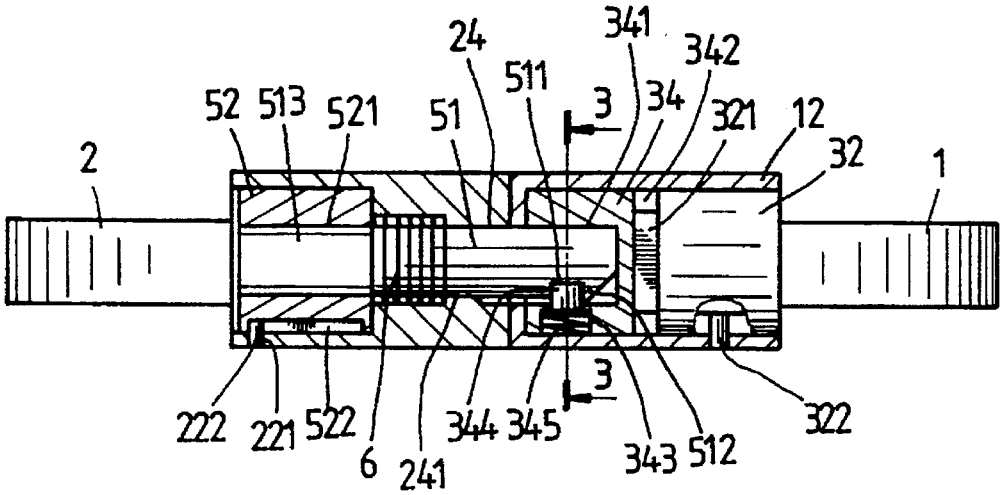
FIG. 11 is an elevational view, partially cut-away, of the third embodiment of the present invention shown in its locked state.
Figure 12:
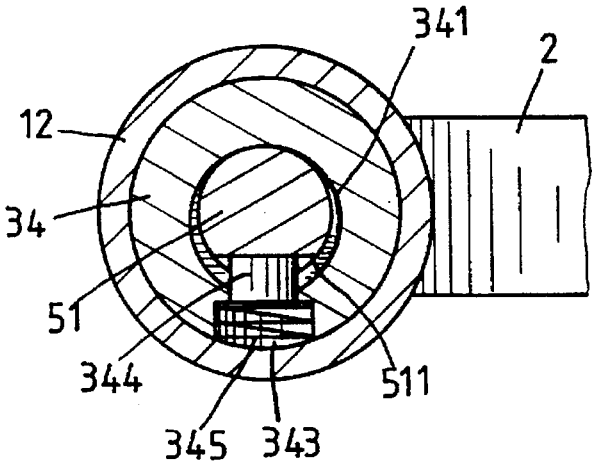
FIG. 12 is a cross-sectional view taken along arrows 3—3 of FIG. 11.

Referring to FIG. 11, when the ends of the two half-collars 1, 2 are brought together, the latch hook slides into locking bed 12, snap head 512 of step latch 51 contacting latch 344. Latch 344 is advanced upward by the slanted surface of snap head 512 as snap head 512 advances axially into counterbore 341 of follower 34 until snap head 512 advances past latch 344. At that point, latch 344 drops down into engagement with locking slot 511 of step latch 51 under the force of spring 345, as shown in FIG. 12.

Figure 13:
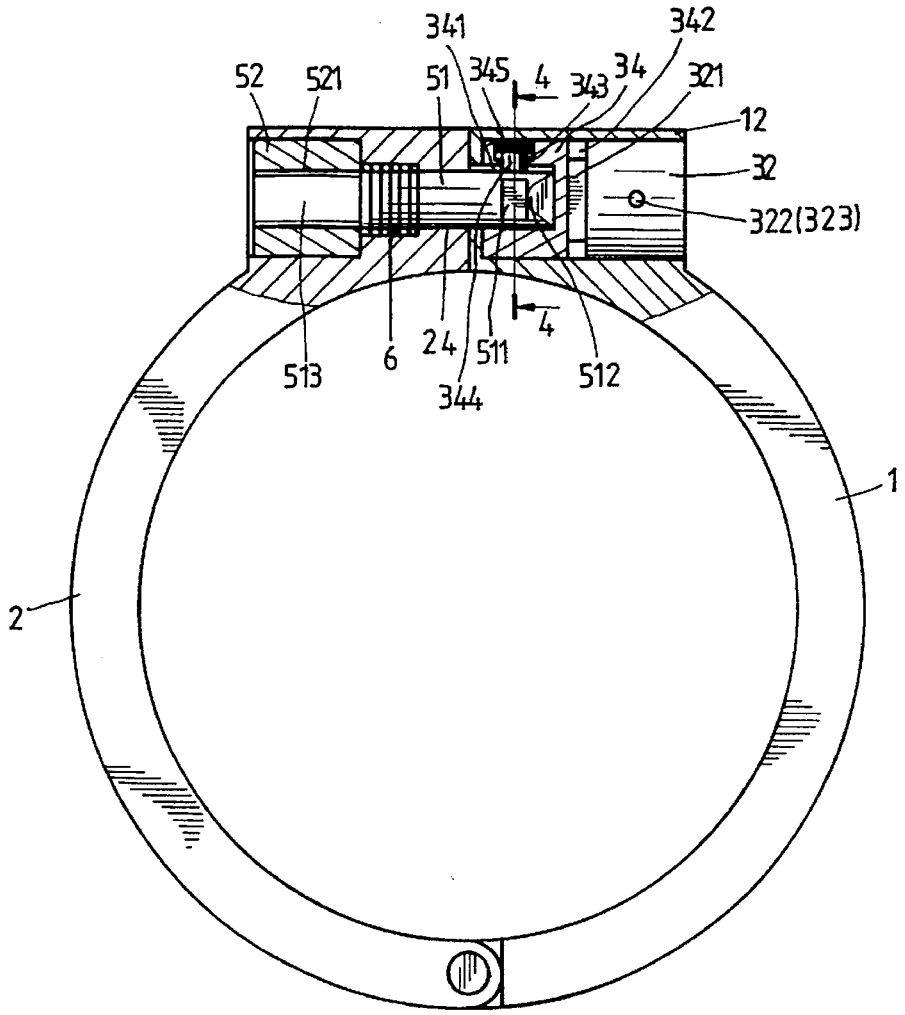
FIG. 13 is a plan view, partially cut-away, of the third embodiment of the present invention shown in its unlocked state.
Figure 14:
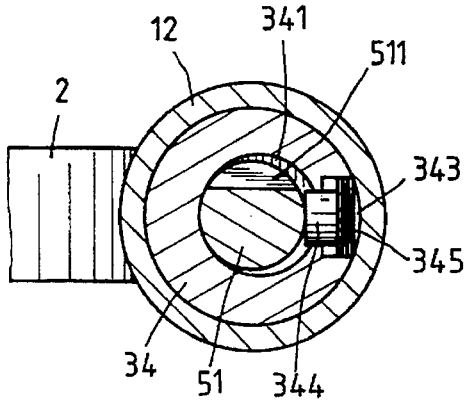
FIG. 14 is a cross-sectional view taken along arrows 4—4 of FIG. 13.

Referring to FIG. 13, unlocking may be effected by inserting and turning a matched key (not shown) in cylinder 32 to cause the rotation of follower 34. As follower 34 rotates, latch 344 is displaced out of its engagement with slot 511. As this displacement occurs, latch 344 is forced away from stop latch 51, compressing spring 345 as shown in FIG. 14. Latch 5 is then free to be withdrawn to release the lock engagement.

Figure 15:
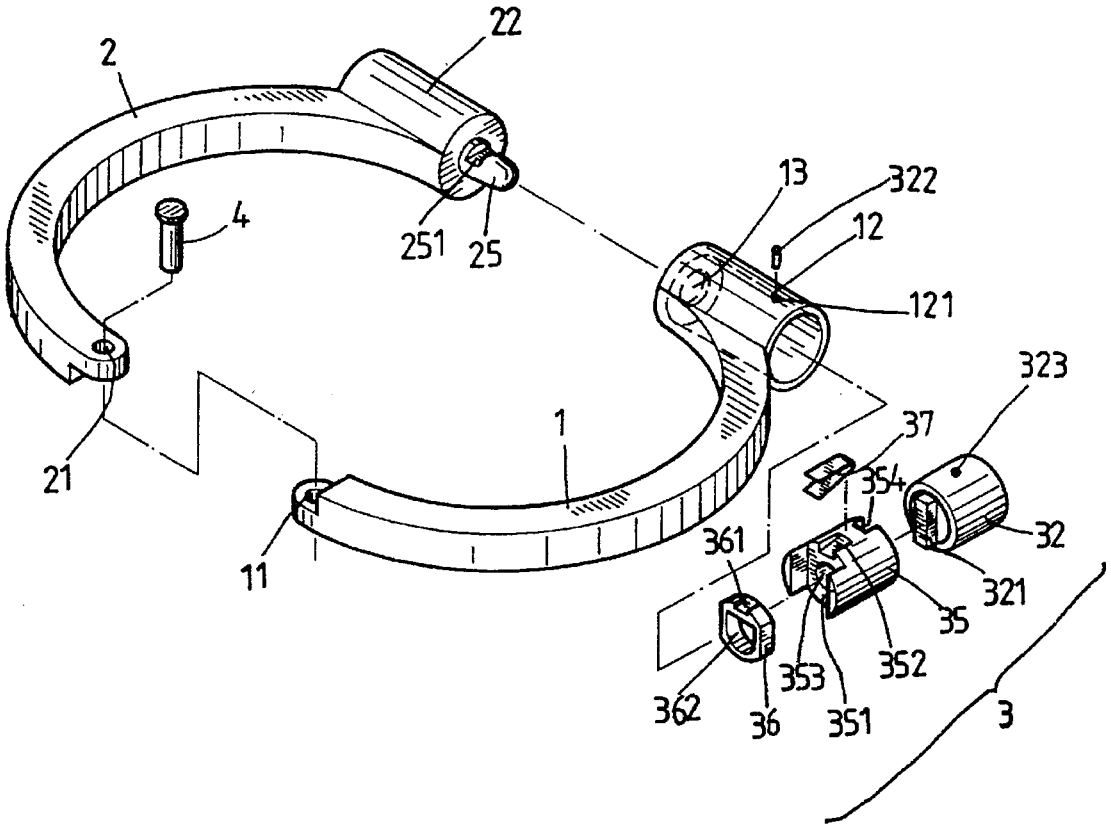
FIG. 15 is an exploded perspective view showing a fourth embodiment of the present invention.

Referring to FIG. 15, there is shown yet another embodiment of the present invention. In this embodiment, a locking unit 3 includes a locking plate 36, a follower 35, a spring leaf 37, and a cylinder 32. Follower 35 has formed thereon a fillister 351 for holding a sliding locking plate 36 at an end opposing leading edge 13 of locking bed 12. On top surfaces of follower 35 and locking plate 36, there are respectively formed notches 352, 361 for cooperatively receiving therein spring leaf 37. A recess 353 is formed in a portion of fillister 351, and a slotted opening 362 is formed through the center of locking plate 36. Slotted opening 362 and recess 353 receive a latch hook formed onto lock block 22. The other end of follower 35 is formed with a camming slot 354 for the insert therein of a camming block 321 formed onto cylinder 32. From lock block 22 extends a latch hook defined by a bulbous head 25 and a locking slot 251.

Figure 16:
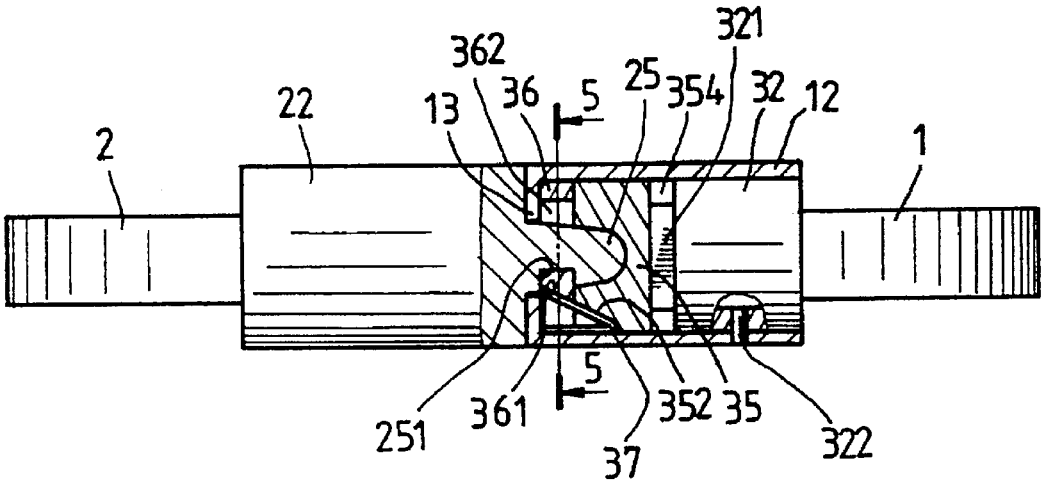
FIG. 16 is an elevational view, partially cut-away, of the fourth embodiment of the present invention shown in its locked state.
Figure 17:
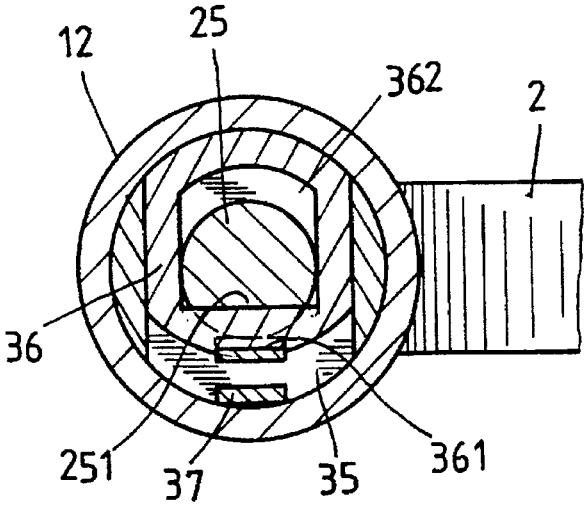
FIG. 17 is a cross-sectional view taken along arrows 5—5 of FIG. 16.

When the ends of half-collars 1, 2 are joined, as shown in FIGS. 16, 17, bulbous head 25 of the latch hook forces locking plate 36 radially upward as it advances into locking bed 12. When the latch hook advances sufficiently to extend into recess 353 of follower 35, locking plate 36 moves downward into engagement with locking slot 251 under the force of spring leaf 37.

Figure 18:
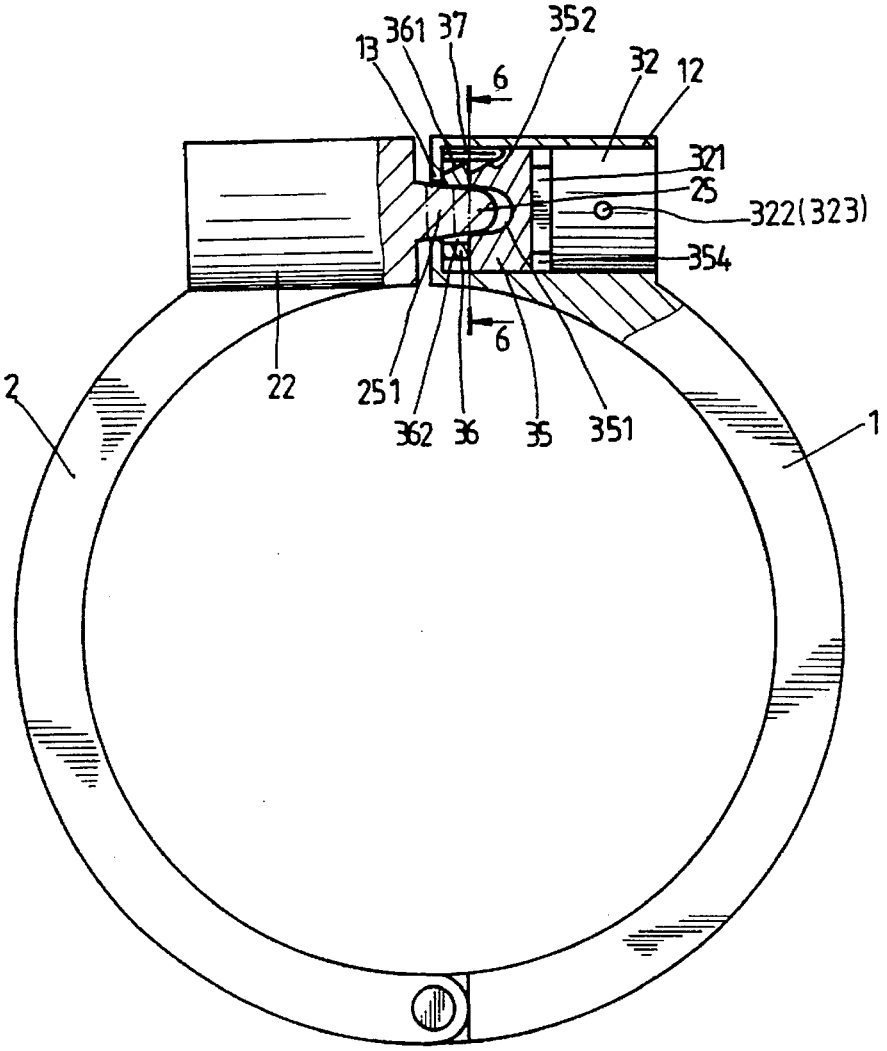
FIG. 18 is a plan view, partially cut-away, of the fourth embodiment of the present invention shown in its unlocked state.
Figure 19:
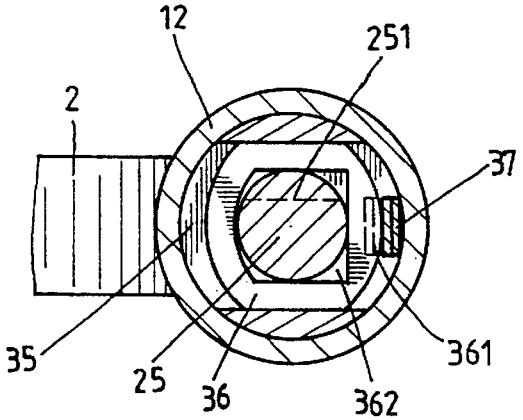
FIG. 19 is a cross-sectional view taken along arrows 6—6 of FIG. 18.
Figure 20:
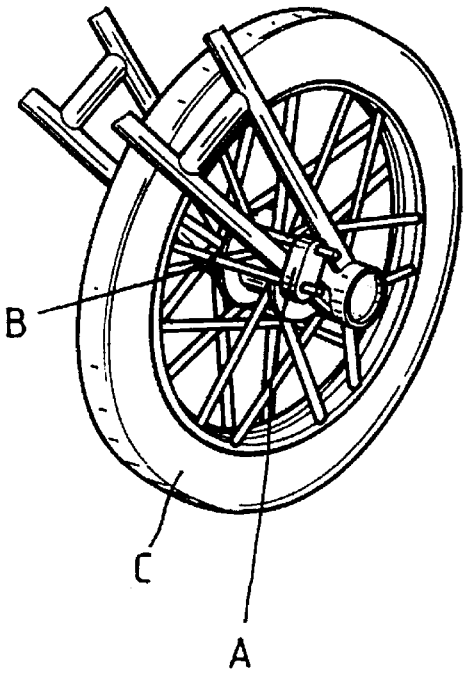
FIG. 20 (PRIOR ART)
FIG. 20 is a perspective view showing a prior art wheel lock assembly.
Figure 21:
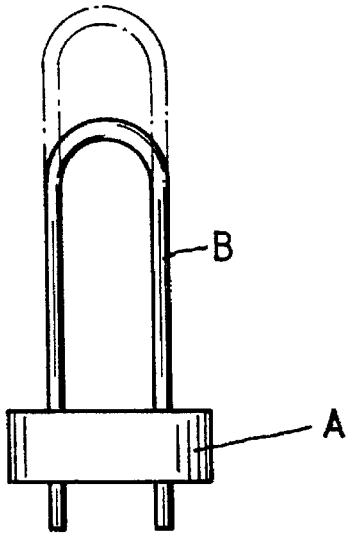
FIG. 21 (PRIOR ART)
FIG. 21 is an elevational view showing the prior art wheel lock assembly of FIG. 20, illustrating its unlocking action.

Unlocking is effected as shown in FIGS. 18, 19, by inserting and turning a matched key (not shown) within cylinder 32 to cause camming block 321 of cylinder 32 to rotate follower 35. Locking plate 36 rotates with follower 35 out of biased engagement with locking slot 251. The latch hook is then free to withdraw from locking bed 12, the lock thus being released.

I claim:

1. A lock for securing a vehicle or a component thereof comprising:

(a) a first half-collar having distal first and second ends, said second end having a plug member protruding along a first coupling axis therefrom, said plug member terminating in a lobe portion, said lobe portion having an elongate contour extending in a direction transverse to said first coupling axis;

(b) a second half-collar having distal first and second ends, said first end being pivotally coupled to said first end of said first half-collar, said second end having formed thereon a substantially tubular locking bed defining an inner chamber extending along a second coupling axis, said locking bed having adjacent one axial end thereof a leading edge formed by a flange portion extending radially inward into said inner chamber; and, (c) a lock assembly coaxially received within said locking bed of said second half-collar for lockingly engaging said plug member of said first half-collar, said lock assembly including:

(i) a lock cylinder having cam means adapted for key-actuated rotation about said second coupling axis;

(ii) a follower coupled to said cam means of said lock cylinder, said follower being adapted to rotate about said second coupling axis responsive to said rotation of said cam means, said follower having formed at an axial end thereof a counterbore adapted to coaxially receive therein said lobe portion of said first half-collar plug member; and, (iii) a substantially planar clip disk coaxially captured between said follower and said leading edge of said locking bed adapted to rotate about said second coupling axis responsive to said rotation of said follower, said clip disk having formed therethrough a substantially radially extended elongate slot adapted for selective passage therethrough of said first half-collar plug member lobe portion along said second coupling axis when said elongate slot and said lobe portion are oriented to extend in substantially parallel radial directions relative to said second coupling axis.

2. The lock as recited in claim 1 wherein said clip disk of said lock assembly is fixedly coupled to said follower thereof, said follower including:

(a) a cam disk having a polygonal opening formed therethrough for matingly engaging said cam means of said lock cylinder, and (b) a camber surface extending along said second coupling axis, said camber surface connecting said clip disk to said cam disk.

3. A lock for securing a vehicle or a component thereof comprising:

(a) a first half-collar having distal first and second ends, said second end having displaceably received therein an elongate latch hook member extending along a first coupling axis, said latch hook member being biased to project axially outward from said second end, said latch hook terminating in a snap head portion having a slant surface characterized by a predetermined incline, said latch hook member having transaxially formed therein adjacent said snap head portion a locking slot;

(b) a second half-collar having distal first and second ends, said first end being pivotally coupled to said first end of said first half-collar, said second end having formed thereon a substantially tubular locking bed defining an inner chamber extending along a second coupling axis, said locking bed having adjacent one axial end thereof a leading edge formed by a flange portion extending radially inward into said inner chamber; and, (c) a lock assembly coaxially received within said locking bed of said second half-collar for lockingly engaging said latch hook member of said first half-collar, said lock assembly including:

(i) a lock cylinder having cam means adapted for key-actuated rotation about said second coupling axis; and, (ii) a follower coaxially captured between said lock cylinder and said leading edge of said locking bed, said follower being coupled to said cam means of said lock cylinder to rotate about said second coupling axis responsive to said rotation of said cam means, said follower having formed at a front axial end thereof a counterbore adapted to coaxially receive therein at least a portion of said first half-collar latch hook member, said follower having disposed therein adjacent said front axial end thereof a step latch member biased to extend transaxially into said counterbore, said step latch being adapted to engage said locking slot of said first half-collar latch hook member inserted within said counterbore when said follower is angularly oriented relative to said latch hook member in a predetermined manner, whereby said snap head of said latch hook is blocked from coaxial withdrawal thereof.

4. A lock for securing a vehicle or a component thereof comprising:

(a) a first half-collar having distal first and second ends, said second end having a latch hook member protruding along a first coupling axis therefrom, said latch hook member terminating in a bulbous head portion, said latch hook member having transaxially formed therein adjacent said bulbous head portion a locking slot;

(b) a second half-collar having distal first and second ends, said first end being pivotally coupled to said first end of said first half-collar, said second end having formed thereon a substantially tubular locking bed defining an inner chamber extending along a second coupling axis, said locking bed having adjacent one axial end thereof a leading edge formed by a flange portion extending radially inward into said inner chamber; and, (c) a lock assembly coaxially received within said locking bed of said second half-collar for lockingly engaging said latch hook member of said first half-collar, said lock assembly including:

(i) a lock cylinder having cam means adapted for key-actuated rotation about said second coupling axis;

(ii) a follower coupled to said cam means of said lock cylinder, said follower being adapted to rotate about said second coupling axis responsive to said rotation of said cam means, said follower having formed at a front axial end thereof a counterbore adapted to coaxially receive therein at least a portion of said first half-collar latch hook member;

(iii) a clip disk coaxially captured between said follower and said leading edge of said locking bed adapted to rotate about said second coupling axis responsive to said rotation of said follower, said clip disk being slidably coupled to said follower to be transaxially displaceable relative thereto, said clip disk having formed therethrough an opening for receiving therethrough said first half-collar latch hook member; and, (iv) biasing means coupled to said clip disk and said follower for resiliently biasing said clip disk in a predetermined transaxial direction relative to said follower, whereby said clip disk is displaced relative to said follower in said transaxial direction to lockingly engage said locking slot of said first half-collar latch hook member passed therethrough when said follower is angularly oriented relative to said latch hook member in a predetermined manner.

* * * * *